US007230638B2

(12) United States Patent
Fukutomi

(10) Patent No.: US 7,230,638 B2
(45) Date of Patent: Jun. 12, 2007

(54) IMAGE FORMING APPARATUS HAVING A PLURALITY OF LASER SCANNER UNITS

(75) Inventor: Akihiro Fukutomi, Shizuoka-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/566,437

(22) PCT Filed: Jul. 21, 2005

(86) PCT No.: PCT/JP2005/013790

§ 371 (c)(1),
(2), (4) Date: Jan. 31, 2006

(87) PCT Pub. No.: WO2006/009307

PCT Pub. Date: Jan. 26, 2006

(65) Prior Publication Data

US 2006/0290773 A1 Dec. 28, 2006

(30) Foreign Application Priority Data

Jul. 21, 2004 (JP) ..... 2004-212857
Jul. 8, 2005 (JP) ..... 2005-200465

(51) Int. Cl.
*G03G 15/00* (2006.01)

(52) U.S. Cl. ..... 347/243; 347/261

(58) Field of Classification Search ..... 347/241, 347/261, 233, 243, 256, 260
See application file for complete search history.

(56) References Cited

U.S. PATENT DOCUMENTS 5,650,253 A * 7/1997 Baker et al. ..... 430/119
5,916,718 A * 6/1999 Kellie et al. ..... 430/45
6,477,348 B2 11/2002 Miyamoto et al. ..... 399/299
6,934,497 B2 8/2005 Hagiwara et al. ..... 399/299

FOREIGN PATENT DOCUMENTS

| | | | |
|---|---|---|---|
| JP | 10-221617 | 8/1998 | |
| JP | 10-228148 | 8/1998 | |
| JP | 2001-42595 | 2/2001 | |
| JP | 2001-209234 | 8/2001 | |
| JP | 2001-337510 | 12/2001 | |
| JP | 2003-159835 | 6/2003 | ..... 347/115 |
| JP | 2003-211728 | 7/2003 | |
| JP | 2003-279875 | 10/2003 | |
| JP | 2003-337454 | 11/2003 | |
| WO | 03/101742 | 12/2003 | |

* cited by examiner

*Primary Examiner*—Huan Tran
(74) *Attorney, Agent, or Firm*—Fitzpatrick, Cella, Harper & Scinto

(57) ABSTRACT

An image forming device, characterized in that the shape of the optical path of a third laser beam from a third semiconductor laser (19M) to a third photo-sensitive member drum (IM) is approximately the same as that of the optical path of a first laser beam from a first semiconductor laser (19C) to a first photo-sensitive member drum (1C), a second virtual line connecting the rotating center of the third photo-sensitive member drum (IM) to the rotating center of a fourth photo-sensitive member drum (IK) is tilted relative to a first virtual line connecting the rotating center of the first photo-sensitive member drum (1C) to the rotating center of the second photo-sensitive member drum (IY), and an angle formed by the rotating axis (x2) of a second rotating polygon mirror (20*b*) and the second virtual line (12) is equal to an angle formed by the rotating axis (x1) of a first rotating polygon mirror (20*a*) and the first virtual line (11).

13 Claims, 13 Drawing Sheets

IMAGE FORMING APPARATUS HAVING A PLURALITY OF LASER SCANNER UNITS

TECHNICAL FIELD

The present invention relates to an image forming apparatus having a plurality of laser scanner units, such as a color copying machine or a color printer.

BACKGROUND ART

As a color copying machine, a color printer or the like using electrophotography, there is available one in which four photosensitive members are arranged in tandem. A tandem-type image forming apparatus is advantageous in that it allows the use of relatively many types of recording media and that it has high recording speed, and the tandem-type image forming apparatus is becoming mainstream as a recent color image forming apparatus.

As a form of such a tandem-type image forming apparatus, Japanese Patent Application Laid-Open No. 2003-279875 and Japanese patent Application Laid-Open No. H10-221617 disclose apparatuses in which two laser scanner units are provided for four photosensitive members (2-box type). In each of the laser scanner units mounted in this type of image forming apparatus, one polygon mirror is used for two optical systems (common use), thereby achieving a reduction in the size and cost of the image forming apparatus.

In some tandem-type image forming apparatuses, the four photosensitive members are not arranged in a straight line. Japanese Patent Application Laid-Open No. 2001-42595 discloses a construction in which, of the first through fourth photosensitive members, the second and third photosensitive members protrude toward the transfer belt by approximately 1 mm. In the apparatus as disclosed in the above-mentioned publication, in the full color printing mode, the transfer belt for conveying recording sheets is in contact with all the four photosensitive members, whereas, in the monochrome printing mode, the transfer belt is separated from the three photosensitive members other than the photosensitive member for black. Since the second and third photosensitive members protrude toward the transfer belt by approximately 1 mm, the recording sheet carrying surface of the transfer belt is flat at the time of monochrome printing while maintaining an appropriate contact state of the transfer belt with respect to each photosensitive member at the time of full color printing, so that it is possible to prevent the recording sheet from being separated from the transfer belt.

In the apparatus disclosed in this publication, the laser scanner units corresponding to the four photosensitive members constructed of four separate units (4-box type), so it is possible to realize an optically appropriate layout by shifting the second and third laser scanner units, which are of the same construction, in parallel toward the transfer belt by the same distance by which the second and third photosensitive members protrude toward the transfer belt (which, in this case, is 1 mm).

However, when applying a 2-box type laser scanner unit, which is advantageous from the viewpoint of achieving a reduction in size and cost, to an apparatus in which the four photosensitive members are not arranged in a straight line, the following problem is involved.

For example, in the image forming apparatus shown in FIG. 4, a photosensitive drum 300 is provided at a position where its optical path length is larger by 1 mm as compared with that of a photosensitive drum 301 (A−B=1 mm).

Further, a photosensitive drum 303 is provided at a position where its optical path length is larger by 0.5 mm as compared with that of a photosensitive drum 302 (301) (C−B=0.5 mm). To maintain a uniform imaging state on each photosensitive drum, imaging lenses 101 and 102 are of the same optical characteristics, whereas imaging lenses 100 and 103 have different optical characteristics. Thus, the two laser scanner units 200 and 201 are of different constructions. This difference in construction makes the advantage of the 2-box type apparatus in terms of cost so much the less.

DISCLOSURE OF THE INVENTION

The present invention has been made in view of the above problem in the prior art. It is an object of the present invention to provide an image forming apparatus which helps to achieve a reduction in cost.

Another object of the present invention is to provide an image forming apparatus in which the optical characteristics of optical elements mounted in a first laser scanner unit can be made the same as those of optical elements mounted in a second laser scanner unit.

Further another object of the present invention is to provide an image forming apparatus including:

a first laser scanner unit for emitting a first laser beam and a second laser beam, which has a first laser source for generating the first laser beam, a second laser source for generating the second laser beam, and a first rotary mirror for deflecting the first laser beam and the second laser beam generated from the first laser source and the second laser source;

a second laser scanner unit for emitting a third laser beam and a fourth laser beam, which has a third laser source for generating the third laser beam, a fourth laser source for generating the fourth laser beam, and a second rotary mirror for deflecting the third laser beam and the fourth laser beam generated from the third laser source and the fourth laser source;

a first photosensitive member irradiated with the first laser beam;

a second photosensitive member irradiated with the second laser beam;

a third photosensitive member irradiated with the third laser beam; and a fourth photosensitive member irradiated with the fourth laser beam, characterized in that:

an optical path configuration for the third laser beam from the third laser source to the third photosensitive member is substantially the same as an optical path configuration for the first laser beam from the first laser source to the first photosensitive member;

an optical path configuration for the fourth laser beam from the fourth laser source to the fourth photosensitive member is substantially the same as an optical path configuration for the fourth laser beam from the second laser source to the second photosensitive member; and a second virtual line connecting a rotation center of the third photosensitive member and a rotation center of the fourth photosensitive member is inclined with respect to a first virtual line connecting a rotation center of the first photosensitive member and a rotation center of the second photosensitive member, and an angle made by a rotation axis of the second rotary mirror and the second virtual line being the same as an angle made by a rotation axis of the first rotary mirror and the first virtual line.

Further another object of the present invention is to provide an image forming apparatus including:

a first laser scanner unit for emitting a first laser beam and a second laser beam, which has a first laser source for generating the first laser beam, a second laser source for generating the second laser beam, and a first rotary mirror for deflecting the first laser beam and the second laser beam generated from the first laser source and the second laser source;

a second laser scanner unit for emitting a third laser beam and the fourth laser beam, which has a third laser source for generating the third laser beam, a fourth laser source for generating the fourth laser beam, and a second rotary mirror for deflecting the third laser beam and the fourth laser beam generated from the third laser source and the fourth laser source;

a first photosensitive member irradiated with the first laser beam;

a second photosensitive member irradiated with the second laser beam;

a third photosensitive member irradiated with the third laser beam; and a fourth photosensitive member irradiated with the fourth laser beam, characterized in that:

an optical path configuration for the third laser beam from the third laser source to the third photosensitive member is substantially the same as an optical path configuration for the second laser beam from the second laser source to the second photosensitive member;

an optical path configuration for the fourth laser beam from the fourth laser source to the fourth photosensitive member is substantially the same as an optical path configuration for the first laser beam from the first laser source to the first photosensitive member; and a second virtual line connecting a rotation center of the third photosensitive member and the rotation center of the fourth photosensitive member is inclined with respect to a first virtual line connecting a rotation center of the first photosensitive member and a rotation center of the second photosensitive member, and an angle made by a rotation axis of the second rotary mirror and the second virtual line being the same as an angle made by a rotation axis of the first rotary mirror and the first virtual line.

Further another object of the present invention is to provide an image forming apparatus including:

a first laser scanner unit for emitting a first laser beam and a second laser beam, which has a first laser source for generating the first laser beam, a second laser source for generating the second laser beam, and a first rotary mirror for deflecting the first laser beam and the second laser beam generated from the first laser source and the second laser source;

a second laser scanner unit for emitting a third laser beam and a fourth laser beam, which has a third laser source for generating the third laser beam, a fourth laser source for generating the fourth laser beam, and a second rotary mirror for deflecting the third laser beam and the fourth laser beam generated from the third laser source and the fourth laser source;

a first photosensitive member irradiated with the first laser beam;

a second photosensitive member irradiated with the second laser beam;

a third photosensitive member irradiated with the third laser beam; and a fourth photosensitive member irradiated with the fourth laser beam, characterized in that an angle made by the first laser scanner unit and the second laser scanner unit is equal to an angle made by a first virtual line connecting a rotation center of the first photosensitive member and a rotation center of the second photosensitive member and a second virtual line connecting a rotation center of the third photosensitive member and a rotation center of the fourth photosensitive member.

Further objects of the present invention will become apparent from the following detailed description with reference to the accompanying drawings.

BEST MODE FOR CARRYING OUT THE INVENTION

First Embodiment

Figure 1:
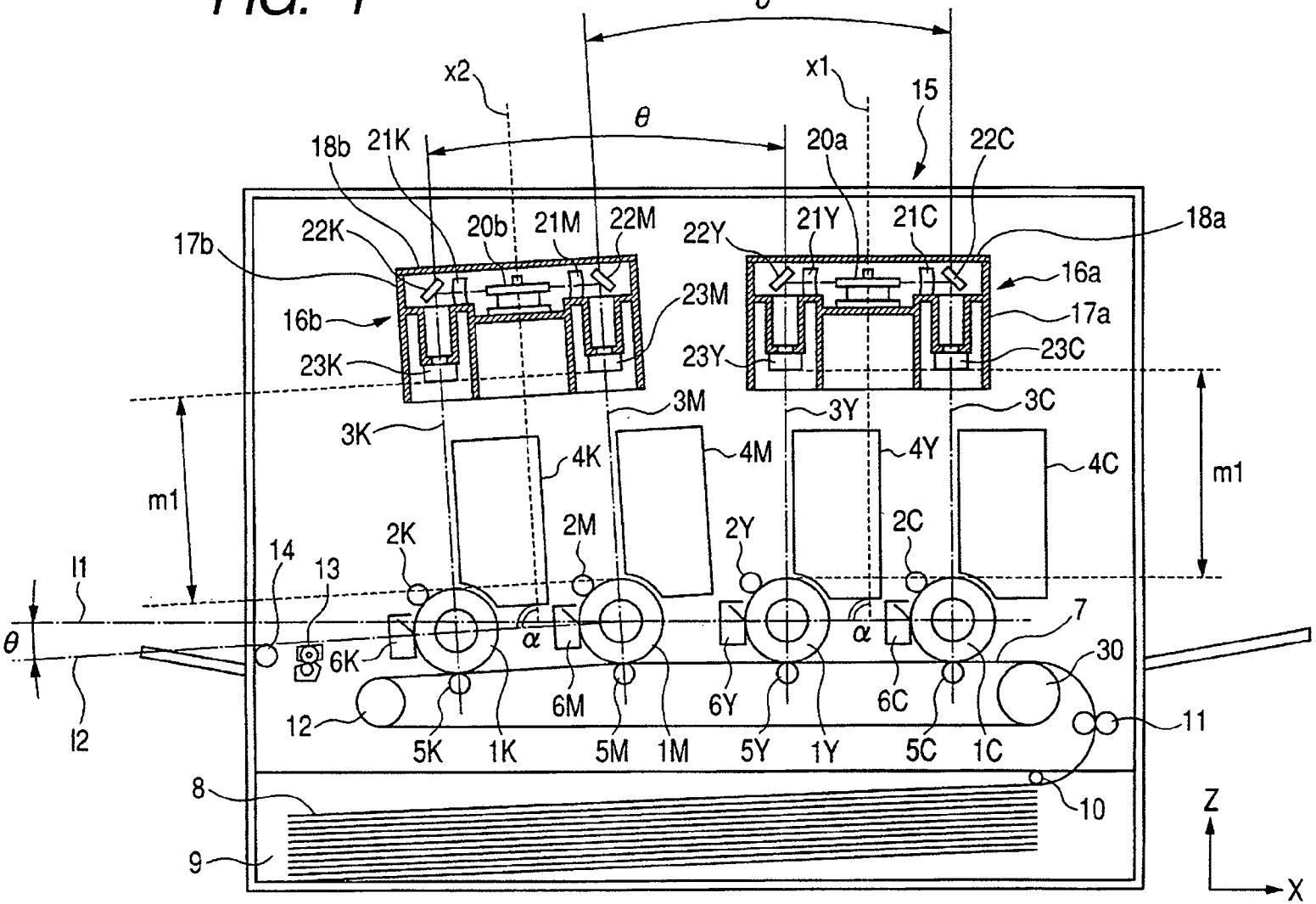
FIG. 1 is a schematic sectional view of an image forming apparatus according to a first embodiment of the present invention.

The first embodiment of the present invention will be described with reference to the drawings. FIG. 1 is an explanatory view of an image forming apparatus according to the first embodiment. The general construction of the image forming apparatus will be described first, and then the construction of a scanning optical device (laser scanner unit) will be described.

(Image Forming Apparatus)

FIG. 1 is a diagram showing an image forming apparatus 15 according to an embodiment of the present invention. The image forming apparatus 15 is capable of forming a color image by superimposing one upon the other toner images of four colors (cyan C, yellow Y, magenta M, and black K), and has four image forming stations. The image forming stations respectively have a first image bearing member (photosensitive drum 1C), a second image bearing member (photosensitive drum 1Y), a third image bearing member (photosensitive drum 1M), and a fourth image bearing member (photosensitive drum 1K).

Further, the image forming apparatus 15 has two scanning optical devices 16 for performing exposure scanning on the four image bearing members (first scanning optical device (first laser scanner unit) 16*a* and second scanning optical device (second laser scanner unit) 16*b*). The first scanning optical device 16*a* and the second scanning optical device 16*b* are of the same construction. The first scanning optical device 16*a* applies a light beam to the photosensitive drum 1C (first photosensitive member) and the photosensitive drum 1Y (second photosensitive member), and the second scanning optical device 16*b* irradiates the photosensitive drum 1M (third photosensitive member) and the photosensitive drum 1K (fourth photosensitive member) with a light beam. The construction of the scanning optical devices 16*a* and 16*b* will be described below.

Around the photosensitive drums 1 (1C, 1Y, 1M, and 1K), there are arranged primary chargers 2 (2C, 2Y, 2M, and 2K) for uniformly charging the photosensitive drums 1, developing devices 4 (4C, 4Y, 4M, and 4K) for developing latent images formed on the photosensitive drums 1, transfer rollers 5 (5C, 5Y, 5M, and 5K) for transferring toner images formed on the photosensitive drums 1 to a transfer material 8 conveyed by a transfer belt 7, and cleaners 6 (6C, 6Y, 6M, and 6K) for removing (cleaning) residual toner on the photosensitive drums 1.

In FIG. 1, below the photosensitive drums 1, there are provided a tray 9 on which transfer materials 8 are stacked for accommodation, a feeding roller 10 for sending out the transfer materials 8 one by one from the tray 9, registration rollers 11 for conveying the transfer materials 8 sent out in synchronism with image formation, and the transfer belt 7 for conveying the transfer material 8 successively to the photosensitive drums 1. The transfer belt 7 is stretched between a driving roller 12 and a tension roller 30. The driving roller 12 feeds the transfer belt 7 accurately, and is connected to a driving motor with little unevenness in rotation (not shown). Further, arranged on the downstream side of the transfer belt 7 with respect to the conveying direction for the transfer material 8 are a fixing device 13 for fixing the toner images to the transfer material 8 by heating, pressurization, etc., and a discharging roller 14 for discharging the transfer material 8 having undergone image formation to the exterior of the apparatus.

The image forming operation of the image forming apparatus 15, constructed as described above, will be described. First, the surfaces of the photosensitive drums 1C, 1Y, 1M, and 1K are uniformly charged by the primary chargers 2C, 2Y, 2M, and 2K. Thereafter, light beams (laser beams) 3C, 3Y, 3M, and 3K are emitted from the scanning optical devices 16*a* and 16*b* onto the photosensitive drums 1C, 1Y, 1M, and 1K. The light beams 3C, 3Y, 3M, and 3K are optically modulated based on image information, and latent images corresponding to the image information are formed on the surfaces of the photosensitive drums 1C, 1Y, 1M, and 1K irradiated with the laser beams. The latent images are turned into visible images by being supplied with developers (toners) of the respective colors by the developing devices 4C, 4Y, 4M, and 4K, and become cyan, yellow, magenta, and black toner images, respectively.

The transfer materials 8 are stacked on the tray 9. The transfer materials 8 are fed one by one from the tray 9 by the feeding roller 10, and are then sent onto the transfer belt 7 by the registration rollers 11 in synchronism with the writing of the images.

The toner images of the different colors formed on the photosensitive drums 1 are electrostatically attracted to the transfer roller 5 side by a voltage applied to the transfer rollers 5. Here, the transfer material 8 is conveyed on the transfer belt 7 arranged between the transfer rollers 5 and the photosensitive drums 1, so the toner images of the different colors (cyan image, yellow image, magenta image, and black image) are electrostatically transferred to the transfer material 8, and superimposed one upon the other to form a color image. The color image formed on the transfer material 8 is heat-fixed by the fixing device 13. Thereafter, the transfer material 8 is conveyed by the discharging roller 14, etc. to be discharged to the exterior of the image forming apparatus 15.

After this, residual toner remaining on the surfaces of the photosensitive drums 1 is removed by the cleaners 6. Thereafter, to form the next color image, the photosensitive drums 1 are uniformly charged again by the primary chargers 2.

Apart from the full color mode, in which all of the above-described four image forming stations are used, the image forming apparatus of this embodiment has a monochrome mode in which only the black image forming station is used.

Figure 5:
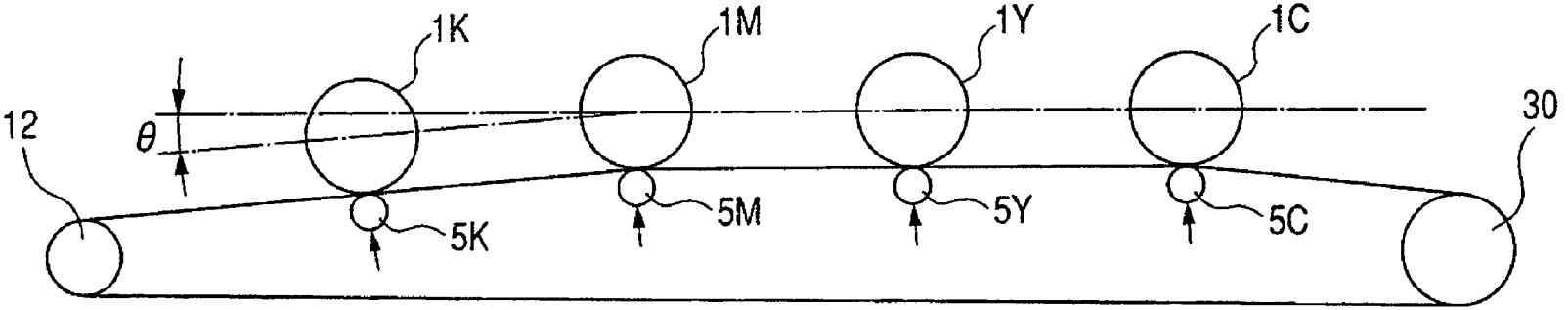
FIG. 5 is a sectional view showing how a transfer belt is in contact with all the photosensitive drums.
Figure 6:
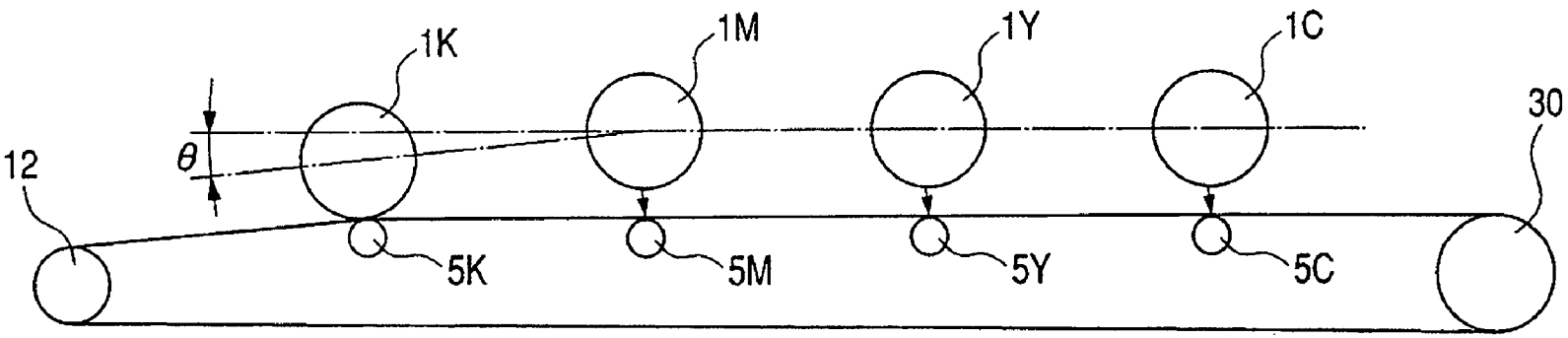
FIG. 6 is a sectional view showing how the transfer belt is separated from three photosensitive drums 1C, 1Y, and 1M.

FIG. 5 shows the condition of the transfer belt 7 in the full color mode, and FIG. 6 shows the condition of the transfer belt 7 in the monochrome mode. In this embodiment, the three transfer rollers 5C, 5Y, and 5M can be moved so as to bring the transfer belt 7 into contact with the photosensitive drums 1C, 1Y, and 1M and so as to separate the transfer belt 7 from the photosensitive drums 1C, 1Y, and 1M (The transfer roller 5K does not move).

As shown in FIG. 5, when performing image formation in the full color mode, the three transfer rollers 5C, 5Y, and 5M push up the transfer belt 7 so that the transfer belt 7 may come into contact with all the photosensitive drums 1C, 1Y, 1M, and 1K. In contrast, as shown in FIG. 6, when performing image formation in the monochrome (black and white) mode, the transfer rollers 5C, 5Y, and 5M except that for black are lowered so that the transfer belt 7 may not come into contact with the three photosensitive drums 1C, 1Y, and 1M. In the monochrome mode, the three photosensitive drums 1C, 1Y, and 1M of the image forming apparatus of this embodiment do not rotate but remain at rest without being used. In this way, in order to suppress a reduction in the service life of the photosensitive drums 1C, 1Y, and 1M due to the rubbing between the photosensitive drums 1C, 1Y, and 1M that do not rotate and the running transfer belt 7, the transfer rollers 5C, 5Y, and 5M are lowered in the monochrome mode so that the transfer belt 7 may not come into contact with the three photosensitive drums 1C, 1Y, and 1M. The transfer roller 5K for black remains at the same position and does not move whether the apparatus is in the full color mode or the monochrome mode.

In this way, in the monochrome mode, the transfer belt 7 of the image forming apparatus of this embodiment is separated from the three photosensitive drums 1C, 1Y, and 1M. In this regard, in the image forming apparatus of this embodiment, in order that the transfer belt 7 may be easily separated from the three photosensitive drums 1C, 1Y, and 1M, the rotation centers of all the photosensitive drums are not arranged in a straight line but the black image photosensitive drum 1K is provided lower than the other photosensitive drums by approximately 1 mm in the vertical direction (direction Z of FIG. 1). Here, assuming that the straight line connecting the rotation center of the photosensitive drum 1C (first photosensitive member) and the rotation center of the photosensitive drum 1Y (second photosensitive member) is a first virtual line l1, and that the straight line connecting the rotation center of the photosensitive drum 1M (third photosensitive member) and the rotation center of the photosensitive drum 1K (fourth photosensitive member) is a second virtual line l2, the first virtual line l1 and the second virtual line l2 are at an angle θ (The second virtual line l2 is inclined with respect to the first virtual line l1). The rotation centers of the three photosensitive drums 1C, 1Y, and 1M are arranged in the same straight line. The four photosensitive drums have the same diameter.

In this way, solely the photosensitive drum 1K is provided lower than the other photosensitive drums, thereby, if the lowering amount of the three transfer rollers is small, making it advantageously possible to separate the transfer belt 7 from the three photosensitive drums 1C, 1Y, and 1M.

In this embodiment, the distance between the centers of the black photosensitive drum 1K and the magenta photosensitive drum 1M is the same as the distance between the centers of the yellow photosensitive drum 1Y and the cyan photosensitive drum 1C, and further, is the same as the distance between the centers of the magenta photosensitive drum 1M and the yellow photosensitive drum 1Y. The two light beams 3C and 3Y emitted from the first scanning optical device 16*a* are parallel to each other. Similarly, the two light beams 3M and 3K emitted from the second scanning optical device 16*b* are parallel to each other.

(Scanning Optical Device (Laser Scanner Unit))

Mounted in the image forming apparatus of this embodiment is a 2-box type laser scanner unit in which four scanning optical systems corresponding to the four photosensitive members are divided into two laser scanner units.

The scanning optical devices 16*a* and 16*b* are provided above the photosensitive drums 1 as shown in FIG. 1. Here, the first scanning optical device 16*a* (first laser scanner unit) and the second scanning optical device 16*b* (second laser scanner unit) are of the same construction.

According to the angle θ made by the first virtual line l1 and the second virtual line l2 mentioned above, the first scanning optical device 16*a* and the second scanning optical device 16*b* are arranged as follows. That is, they are arranged such that the light beam 3Y (second laser beam) emitted from the first scanning optical device 16*a* toward the photosensitive drum 1Y (second photosensitive member) and the light beam 3K (fourth laser beam) emitted from the second scanning optical device 16*b* toward the photosensitive drum 1K (fourth photosensitive member) are at the angle θ. The angle made by the light beam 3C (first laser beam) emitted from the first scanning optical device 16*a* toward the photosensitive drum 1C (first photosensitive member) and the light beam 3M (third laser beam) emitted from the second scanning optical device 16*b* toward the photosensitive drum 1M (third photosensitive member) is also θ.

As shown in FIG. 1, in this embodiment, the distance from the photosensitive drum 1Y (second photosensitive member) to the position where the light beam 3Y is emitted from the first scanning optical device 16*a* (laser beam emission surface of lens 23Y) is set to be the same as the distance from the photosensitive drum 1K (fourth photosensitive member) to the position where the light beam 3K is emitted from the second scanning optical device 16*b* (laser beam emission surface of lens 23K) (Both are set at a distance of m1). Further, in this embodiment, the light beam 3C and the light beam 3Y are parallel to each other, and the light beam 3M and the light beam 3K are also parallel to each other. However, it is not always necessary for the light beams 3C and 3Y to be parallel to each other. This also applies to the light beam 3M and the light beam 3K. In this embodiment, the angle θ is approximately 1° (degree).

Figure 2:
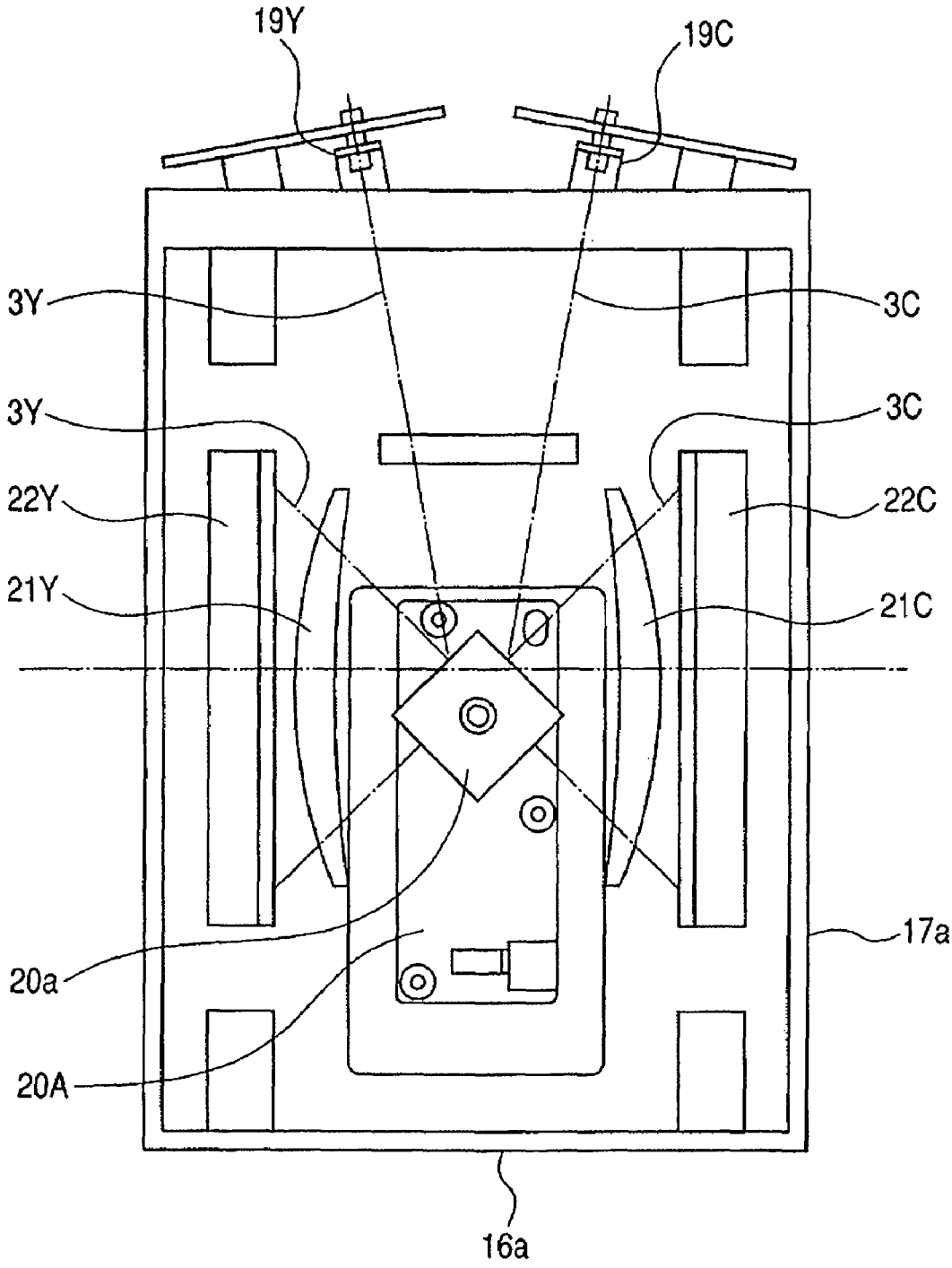
FIG. 2 is an inner constructional view of a laser scanner unit mounted in the image forming apparatus of the first embodiment.

FIG. 2 is a plan view of the scanning optical device 16*a*. Since the second scanning optical device 16*b* is of the same internal construction as the first scanning optical device 16*a*, a description of the second scanning optical device 16*b* will be omitted.

As shown in FIG. 2, the light beams (first laser beam 3C and second laser beam 3Y) emitted from semiconductor lasers 19 (first laser source 19C and second laser source 19Y) as the laser sources in correspondence with image information of the colors (cyan and yellow) are applied for scanning in different directions corresponding to the colors by a rotary polygon mirror (first rotary mirror) 20*a* arranged at the center. The rotary polygon mirror (light deflector) 20*a* is rotated by a driving motor. As shown in FIGS. 1 and 2, the optical components, such as a board 20A on which the driving motor is mounted, scanning lenses (fθ lenses) 21, and turn-back mirrors 22, are contained in an optical box 17*a*. The upper opening of the optical box 17*a* is closed by a cover 18*a*. Both the optical box 17*a* and the optical box 17*b* are formed of resin by using the same mold.

The light beams 3 (3C and 3Y) scanned by the rotary polygon mirror 20*a* are transmitted through the scanning lenses 21 (21C and 21Y), and are reflected by the turn-back mirrors 22 (22C and 22Y) in the direction of the photosensitive drums 1 (downward direction of in FIG. 1). Thereafter, as shown in FIG. 1, the light beams 3 (3C and 3Y) are transmitted through the imaging lenses 23 (23C and 23Y) and emitted from the first scanning optical device 16*a*. After being transmitted through the imaging lenses 23, the light beams 3 effect image formation on the photosensitive drums 1C and 1Y. The distance between the centers of the imaging lens 23C and the imaging lens 23Y is the same as the distance between the photosensitive drum 1C and the photosensitive drum 1Y.

As stated above, in this embodiment, when the first virtual line l1 connecting the rotation centers of the photosensitive drums 1C and 1Y and the second virtual line l2 connecting the rotation centers of the photosensitive drums 1M and 1K are at an angle θ, the two scanning optical devices 16*a* and 16*b* of the same construction are arranged so as to be inclined with respect to each other according to the angle θ. Then, the positional relationship between the second scanning optical device 16*b*, the magenta photosensitive drum 1M, and the black photosensitive drum 1K is the same as the positional relationship between the first scanning optical device 16*a*, the cyan photosensitive drum 1C, and the yellow photosensitive drum 1Y.

With this arrangement, even in the case in which the rotation centers of the photosensitive drums 1C, 1Y, and 1M are arranged in a straight line, and in which the photosensitive drum 1K alone is not provided in the straight line, the respective optical path lengths from the imaging lenses 23 (23C, 23Y, 23M, and 23K) to the photosensitive drums 1 (1C, 1Y, 1M, and 1K) are substantially the same. Thus, the optical path difference is within the scanning optical system lens focal depth, and it is possible to satisfy a predetermined spot diameter.

In this embodiment, the optical path configuration of the third laser beam 3M from the third laser source 19M to the third photosensitive member 1M is substantially the same as the optical path configuration of the first laser beam 3C from the first laser source 19C to the first photosensitive member 1C, and the optical path configuration of the fourth laser beam 3K from the fourth laser source 19K to the fourth photosensitive member 1K is substantially the same as the optical path configuration of the second laser beam 3Y. That is, the third laser beam 3M and the first laser beam 3C are substantially of the same optical path length from the laser source to the photosensitive member, and are substantially of the same reflection angle of the laser beam in the optical path due to the mirror. Further, the fourth laser beam 3K and the second laser beam 3Y are substantially of the same optical path length from the laser source to the photosensitive member, and are substantially of the same reflection angle of the laser beam in the optical path due to the mirror.

In an image forming apparatus which forms a full color image by superimposing toner images of a plurality of colors one upon the other, it is necessary to perform adjustment to suppress scanning line positional deviation, which is a factor of image color drift. In the manufacturing process of the image forming apparatus of this embodiment, the two laser scanner units are mounted to the image forming apparatus main body, and then the lenses 23C, 23Y, 23M, and 23K are shifted in the sub scanning direction to perform irradiation position adjustment for the scanning lines. Although not performed in the image forming apparatus of this embodiment, as other optical adjustment methods, there are also available a method of effecting scanning line irradiation position adjustment by adjusting the angle of the turn-back mirrors 22C, 22Y, 22M, and 22K, and a method of adjusting both those lenses and the mirrors. This scanning line irradiation position adjustment is performed for the purpose of correcting scanning line positional deviation due to the component tolerance of the optical elements, such as the lenses and mirrors, and the optical box, the assembly tolerance at the time of mounting the optical box to the image forming apparatus and at the time of mounting the optical elements to the optical box, etc.; it is an adjustment that must be performed as long as there exists tolerance. For example, its adjustment width is within a range of approximately ±2 mm in the sub scanning direction (drum rotating direction) on the photosensitive drum.

Even when the designing is effected such that the optical path configurations are the same, the optical adjustment for correcting scanning line positional deviation due to tolerance is necessary. Thus, an image forming apparatus in which optical adjustment for correcting scanning line positional deviation due to tolerance has been performed also falls under the category of "substantially of the same optical path configuration".

Further, in this embodiment, the second virtual line l2 connecting the rotation center of the third photosensitive member 1M and the rotation center of the fourth photosensitive member 1K is inclined with respect to the first virtual line l1 connecting the rotation center of the first photosensitive member 1C and the second photosensitive member 1Y by the angle θ. Further, as shown in FIG. 1, the angle α made by the rotation axis x2 of the second rotary mirror 20*b* and the second virtual line l2 is the same as the angle α made by the rotation axis x1 of the first rotary mirror 20*a* and the first virtual line l1.

In this way, the optical path configuration of the third laser beam 3M and the optical path configuration of the first laser beam 3C are substantially the same, and the optical path configuration of the fourth laser beam 3K and the optical path configuration of the second laser beam 3Y are substantially the same, and the angle α made by the rotation axis x2 of the second rotary mirror 20*b* and the second virtual line l2 is the same as the angle α made by the rotation axis x1 of the first rotary mirror 20*a* and the first virtual line l1, so that if the second virtual line l2 is inclined with respect to the first virtual line l1 by the angle θ, it is possible to make the optical characteristics of the plurality of optical elements mounted in the first laser scanner unit substantially the same as those of the plurality of optical elements mounted in the second laser scanner unit. Thus, making effective use of the advantage of a 2-box type laser scanner unit, it is possible to suppress an increase in the cost of an image forming apparatus. In this embodiment, the optical boxes 17*a* and 17*b* are also produced by using the same mold, which further contributes to suppressing an increase in cost. That is, in the case of this embodiment, the two laser scanner units are completely of the same construction.

As shown in FIG. 1, in the case of this embodiment, the direction of the first laser beam 3C from the first rotary mirror 20*a* to the first photosensitive member 1C and the direction of the second laser beam 3Y from the first rotary mirror 20*a* to the second photosensitive member 1Y are opposite to each other. In the optical paths of those two systems, the optical path lengths from the laser source to the photosensitive members are substantially the same, and the reflection angles of the laser beams in the optical paths are also substantially the same, so that, in this case, the optical path configurations can be regarded as the same. This relationship also applies to the third laser beam 3M and the fourth laser beam 3K. That is, the four optical systems are substantially of the same optical path configuration, so that all of the four optical systems corresponding to the four photosensitive members can be formed by using optical elements that are optically substantially the same, which contributes to a further reduction in cost.

When, as in this embodiment, the angle α made by the rotation axis x2 of the second rotary mirror 20*b* and the second virtual line l2 is the same as the angle α made by the rotation axis x1 of the first rotary mirror 20*a* and the first virtual line l1, and the optical path configuration of the first laser beam and the optical path configuration of the third laser beam are substantially the same, and the optical path configuration of the second laser beam and the optical path configuration of the fourth laser beam are substantially the same, the angle made by the first laser beam 3C incident on the first photosensitive member 1C and the third laser beam 3M incident on the third photosensitive member 1M is the same as the angle θ made by the second virtual line l2 and the first virtual line l1. Further, the angle made by the second laser beam 3Y incident on the second photosensitive member 1Y and the fourth laser beam 3K incident on the fourth photosensitive member 1K is also θ.

In this way, the first scanning optical device 16*a* and the second scanning optical device 16*b* are of the same construction, so that there is no need to re-design the imaging lenses 23 to match the optical path lengths with each other, and it is possible to produce the scanning optical devices 16 (16*a* and 16*b*) by the same production process. This facilitates the production management, making it possible to produce the scanning optical devices at low cost. Further, due to the reduction in the production cost of the scanning optical devices, it is also possible to provide the image forming apparatus at low cost.

Further, since the first scanning optical device 16*a* and the second scanning optical device 16*b* are of the same construction, it is possible to minimize the scanning line deviation among the colors. Thus, it is possible to provide a satisfactory image with little color drift.

Figure 7:
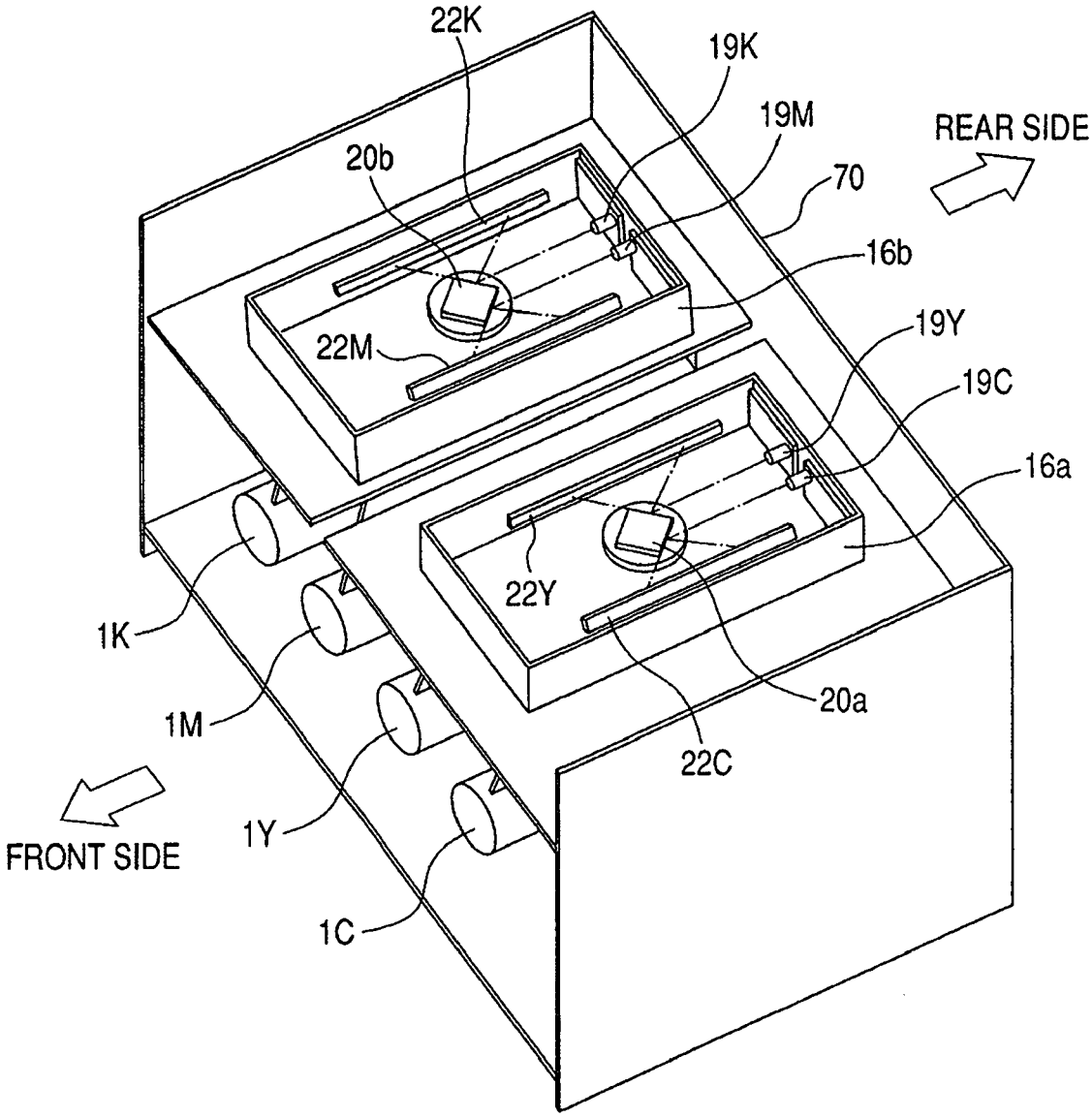
FIG. 7 is a perspective view of the image forming apparatus of the first embodiment.

FIG. 7 is a perspective view of the image forming apparatus of this embodiment, with a part of the external cover of the image forming apparatus and a part of the optical boxes removed to expose the interior of the two laser scanner units.

As stated above, in this embodiment, the optical path configuration of the first laser beam and the optical path configuration of the third laser beam are substantially the same, and the optical path configuration of the second laser beam and the optical path configuration of the fourth laser beam are substantially the same. In this case, as shown in FIG. 7, the two laser sources 19C and 19Y mounted in the first laser scanner unit and the two laser sources 19M and 19K mounted in the second laser scanner unit are arranged on the same side surface 70 (which is the rear side in this embodiment) of the image forming apparatus main body. When all the four laser sources are arranged on the same side surface, it is advantageously easy to arrange the electrical wiring around the drive circuit board on which the laser sources (semiconductor lasers) are mounted, and the assembly of the apparatus is easy to perform.

Figure 8:
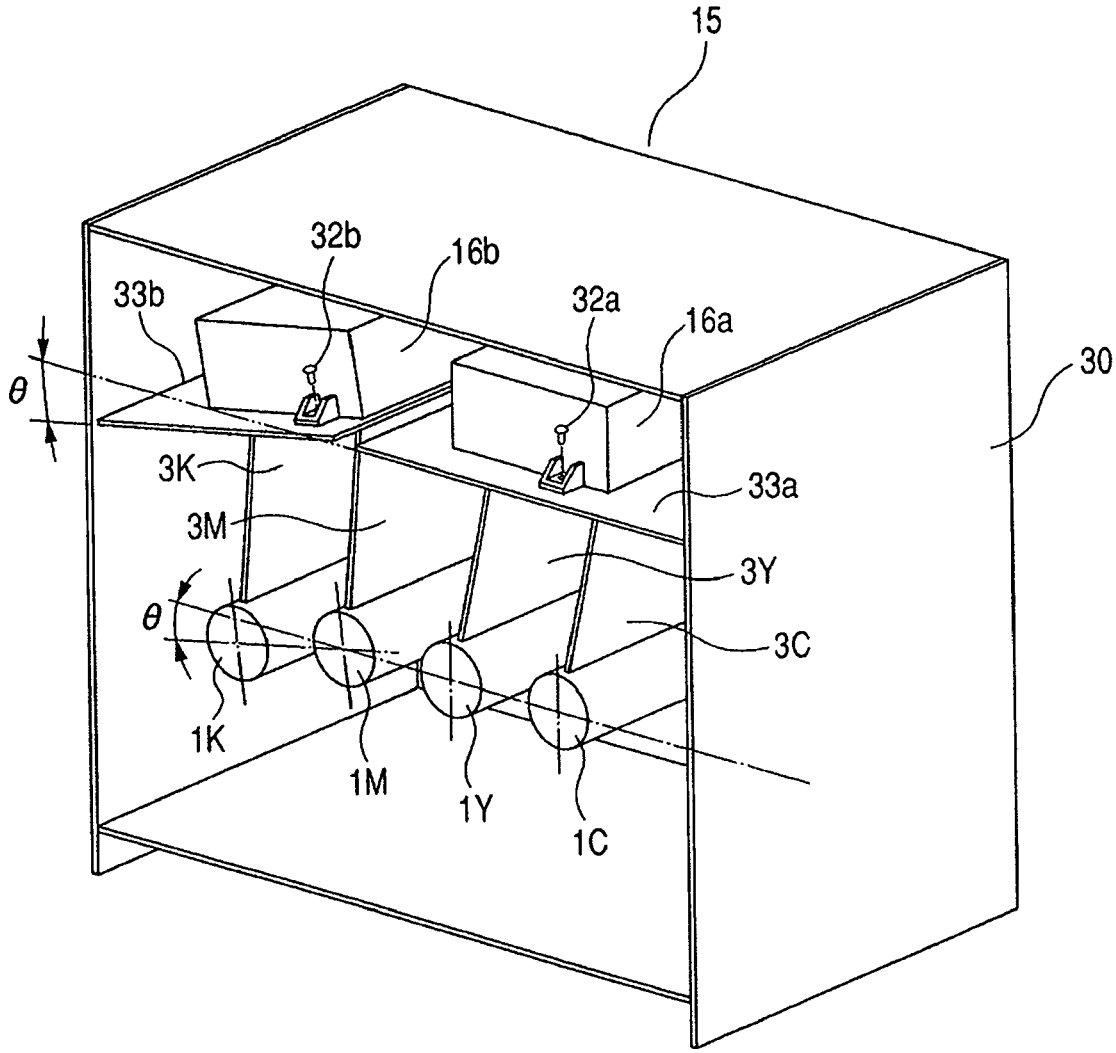
FIG. 8 is a perspective view showing how laser scanner units are mounted in the image forming apparatus of the first embodiment.

Further, as stated above, in this embodiment, the second virtual line l2 is inclined with respect to the first virtual line l1 by the angle θ. At the same time, the second laser scanner unit 16*b* (or the optical box 17*b*) is also inclined with respect to the first laser scanner unit 16*a* (or the optical box 17*a*) by the angle θ. As shown in FIG. 8, in this embodiment, to incline the second laser scanner unit 16*b* with respect to the first laser scanner unit 16*a* by the angle θ, a plate 33*b* (second supporting member) for positioning and supporting the second laser scanner unit 16*b* is inclined with respect to a plate 33*a* (first supporting member) for positioning and mounting the first laser scanner unit 16*a* by the angle θ. The first laser scanner unit 16*a* is mounted to the plate 33*a* by a screw 32*a*, and the second laser scanner unit 16*b* is mounted to the plate 33*b* by a screw 32*b*.

Figure 9:
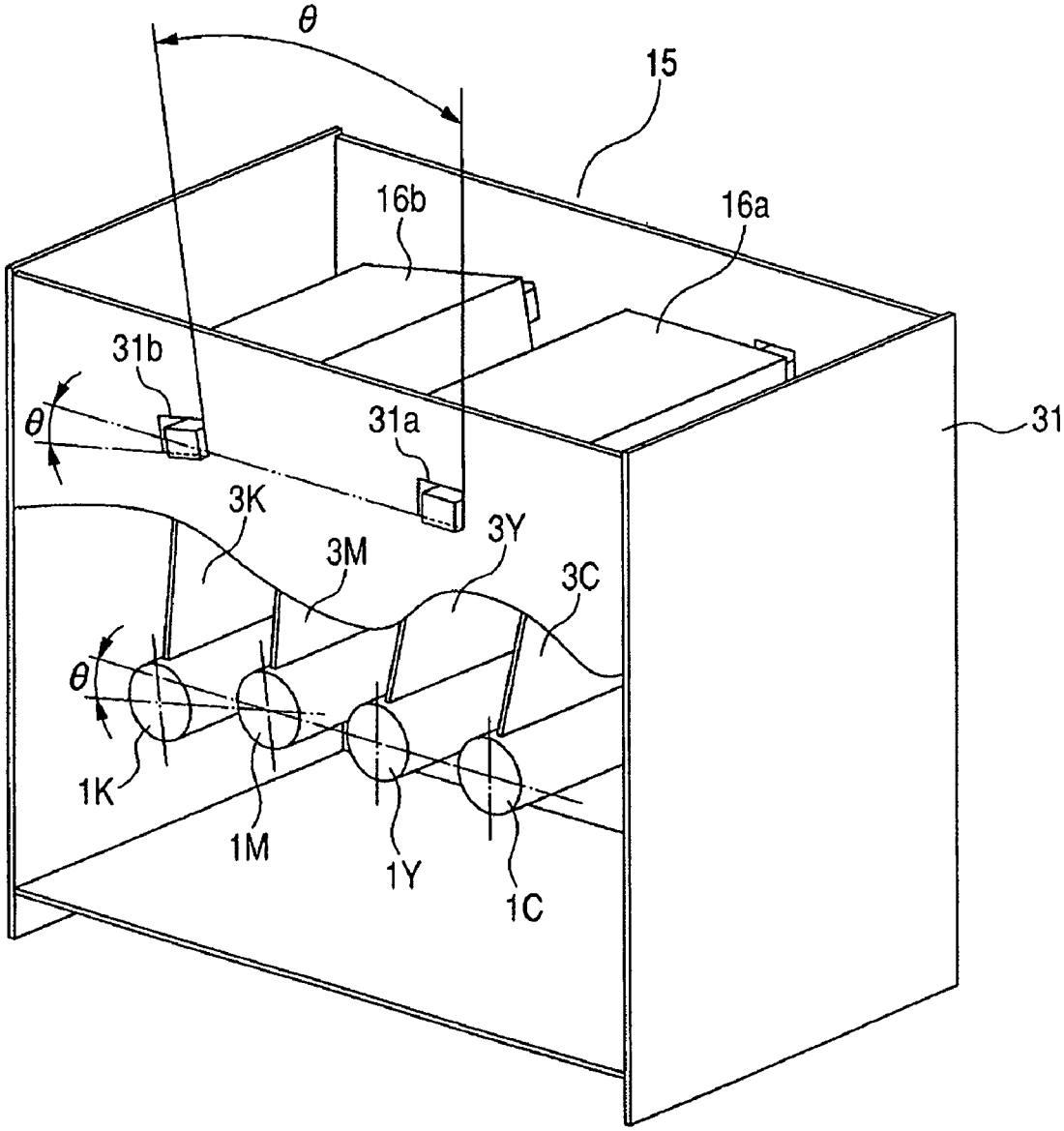
FIG. 9 is a perspective view showing a modification of the way of mounting the laser scanner units.

While in this embodiment the angle made by the two plates 33*a* and 33*b* is θ, it is also possible, as shown in FIG. 9, to provide two holes (positioning portions) in one plate (supporting member) for positioning the two laser scanner units (Such a plate is provided one each on the front side and on the rear side of the image forming apparatus main body), setting the angle made by these holes at θ. In the example of FIG. 9, of the four sides of each rectangular positioning hole, the two sides crossing each other effect positioning on the laser scanner unit. In brief, the angle made by the portions effecting positioning on each laser scanner unit is set at θ. It is desirable for those plates provided on the front side and the rear side of the image forming apparatus main body to be formed of sheet metals processed by using the same pressing machine. By processing those two plates having the positioning holes by using the same pressing machine, it is possible to achieve an improvement in terms of positioning accuracy for the laser scanner unit.

While in this embodiment the optical path configurations of all the four optical systems are substantially the same as stated above, it is not always necessary for the optical path configuration of the first laser beam 3C and the optical path configuration of the second laser beam 3Y to be substantially the same, and it is not always necessary, either, for the optical path configuration of the third laser beam 3M and the optical path configuration of the fourth laser beam 3K to be substantially the same. Thus, it is not always necessary for the plurality of optical elements forming the optical path for the first laser beam 3C to be of the same optical characteristics as the plurality of optical elements forming the optical path for the second laser beam 3Y, and it is not always necessary, either, for the plurality of optical elements forming the optical path for the third laser beam 3M to be of the same optical characteristics as the plurality of optical elements forming the optical path for the fourth laser beam 3K.

Figure 10:
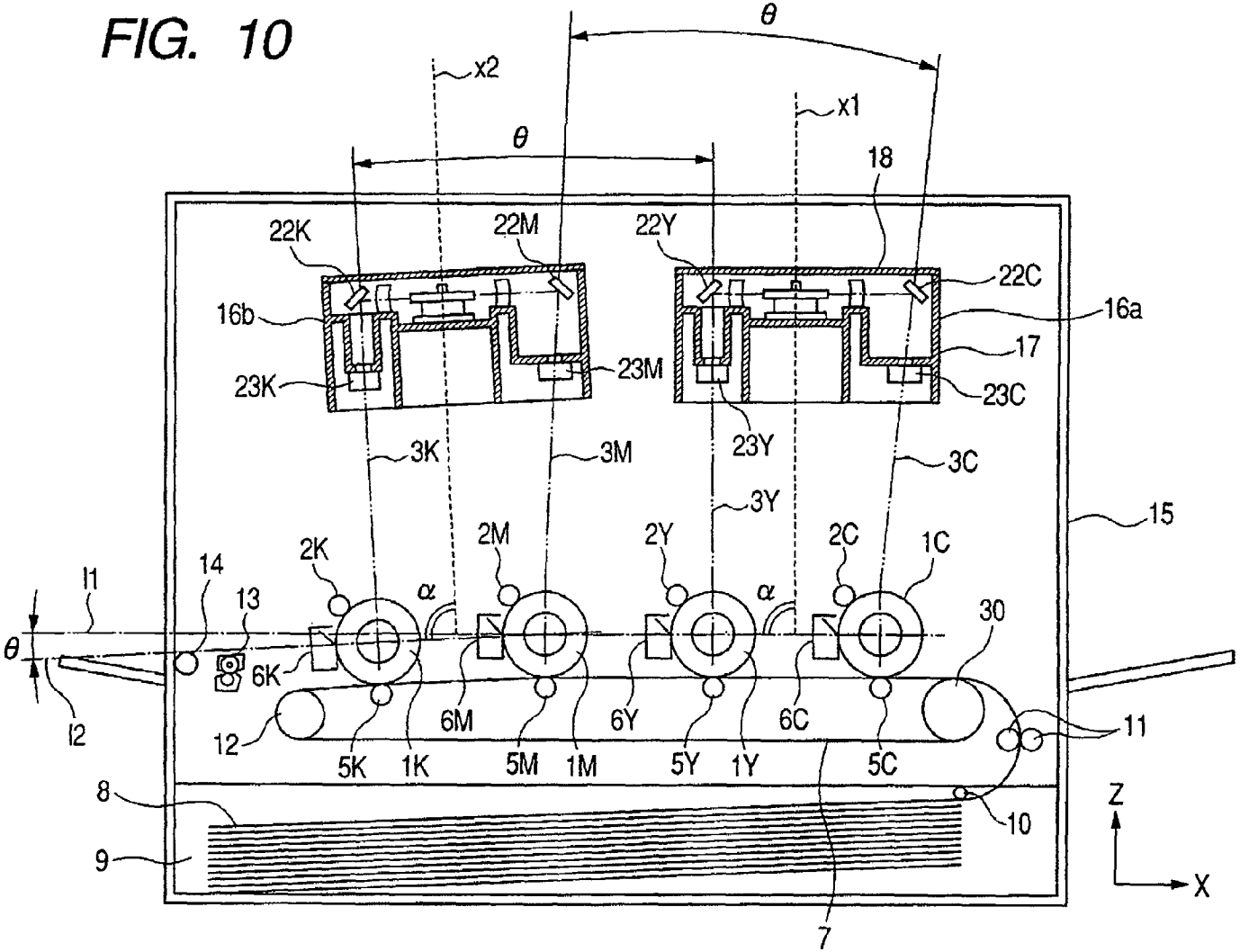
FIG. 10 is a schematic sectional view of a modification of the image forming apparatus of the first embodiment.
Figure 11:
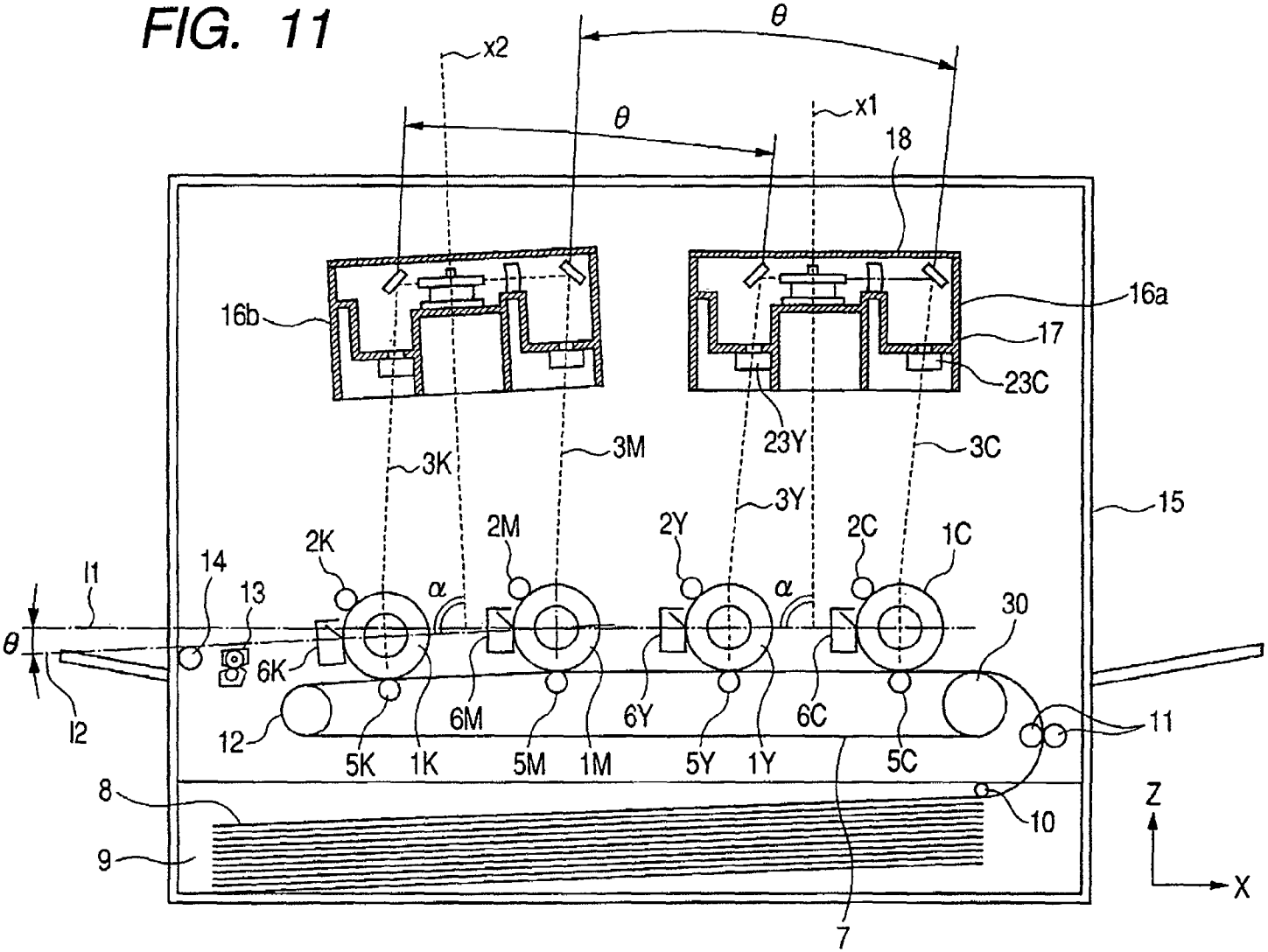
FIG. 11 is a schematic sectional view of a modification of the image forming apparatus of the first embodiment.

For example, in the image forming apparatuses shown in FIGS. 10 and 11, the optical path configuration for the third laser beam 3M and the optical path configuration for the first laser beam 3C are substantially the same, and the optical path configuration for the fourth laser beam 3K and the optical path configuration for the second laser beam 3Y are substantially the same, but the optical path configuration for the first laser beam 3C and the optical path configuration for the second laser beam 3Y are not substantially the same. The optical path configuration for the third laser beam 3M and the optical path configuration for the fourth laser beam 3K are not substantially the same, either. However, also in the image forming apparatuses shown in FIGS. 10 and 11, the optical path configuration for the third laser beam 3M and the optical path configuration for the first laser beam 3C are substantially the same, the optical path configuration for the fourth laser beam 3K and the optical path configuration for the second laser beam 3Y are substantially the same, and the angle α made by the rotation axis x2 of the second rotary mirror 20*b* and the second virtual line l2 is the same as the angle α made by the rotation axis x1 of the first rotary mirror 20*a* and the first virtual line l1, with the first laser scanner unit and the second laser scanner unit being substantially of the same construction.

Further, it is only necessary for the optical path configuration for the third laser beam 3M and the optical path configuration for the first laser beam 3C to be substantially the same, and for the optical path configuration for the fourth laser beam 3K and the optical path configuration for the second laser beam 3Y to be substantially the same. There is no need for the configuration of the optical box of the first laser scanner unit (first optical box) 17*a* to be completely the same as the configuration of the optical box of the second laser scanner unit (second optical box) 17*b*.

Figure 12:
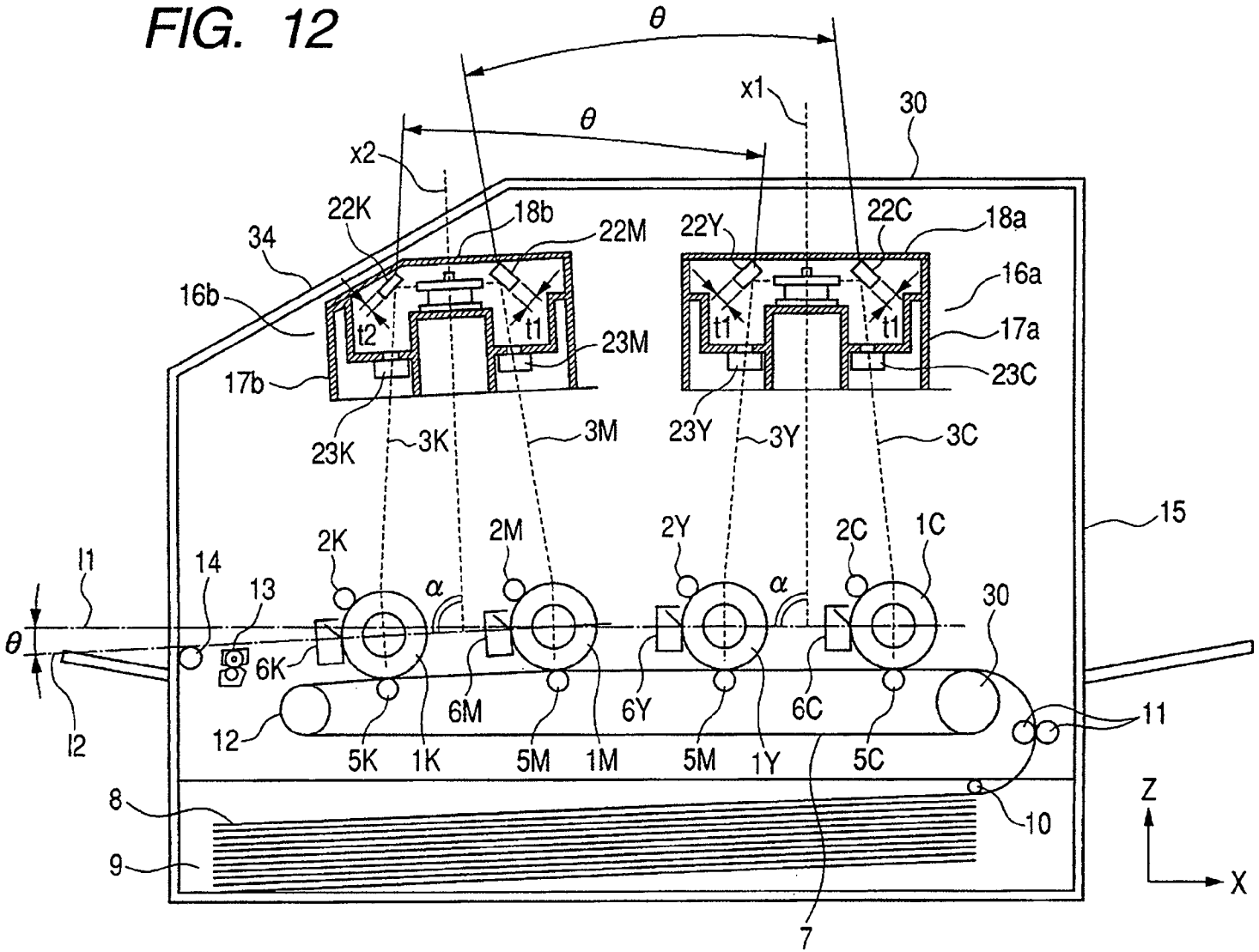
FIG. 12 is a schematic sectional view of a modification of the image forming apparatus of the first embodiment.

For example, in the image forming apparatus shown in FIG. 12, while the optical path configurations of all the laser beams 3M through 3K of the four systems are substantially the same, the configuration of the optical box 17*a* is somewhat different from the configuration of the optical box 17*b*. More specifically, the configurations of the portions of the optical boxes near the mirror 22Y and the mirror 22K are different from each other. Due to this difference in configuration, the thickness t2 of the mirror 22K is smaller than the thickness t1 of the other three mirrors 22C, 22Y, and 22M. However, the mirror 22K and the other mirrors 22C, 22Y, and 22M only differ in thickness, and their optical characteristics are substantially the same. That is, also in the image forming apparatus shown in FIG. 12, the optical path configuration for the third laser beam 3M and the optical path configuration for the first laser beam 3C are substantially the same, and the optical path configuration for the fourth laser beam 3K and the optical path configuration for the second laser beam 3Y are substantially the same, and the angle α made by the rotation axis x2 of the second rotary mirror 20*b* and the second virtual line l2 is the same as the angle α made by the rotation axis x1 of the first rotary mirror 20*a* and the first virtual line l1, with the plurality of optical elements mounted in the first laser scanner unit and the second laser scanner unit (mirrors 22C through 22K and lenses 23C through 23K) being substantially of the same construction.

However, from the viewpoint of a reduction in cost, it is very advantageous and desirable for the optical boxes and the optical elements mounted therein to be all substantially of the same construction as in the first laser scanner unit 16*a* and the second laser scanner unit 16*b* of this embodiment.

Second Embodiment

Figure 3:
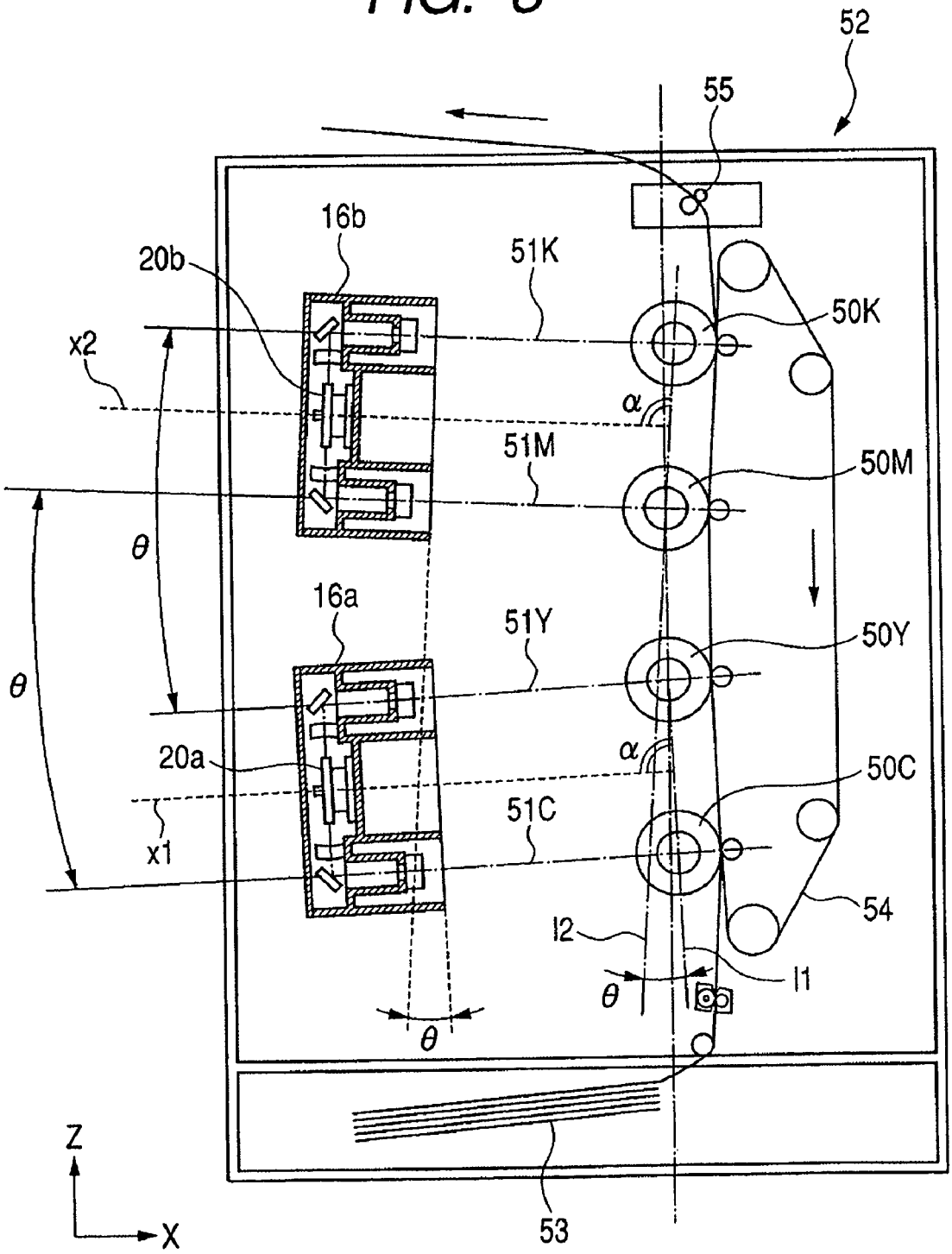
FIG. 3 is a schematic sectional view of an image forming apparatus according to a second embodiment of the present invention.
Figure 4:
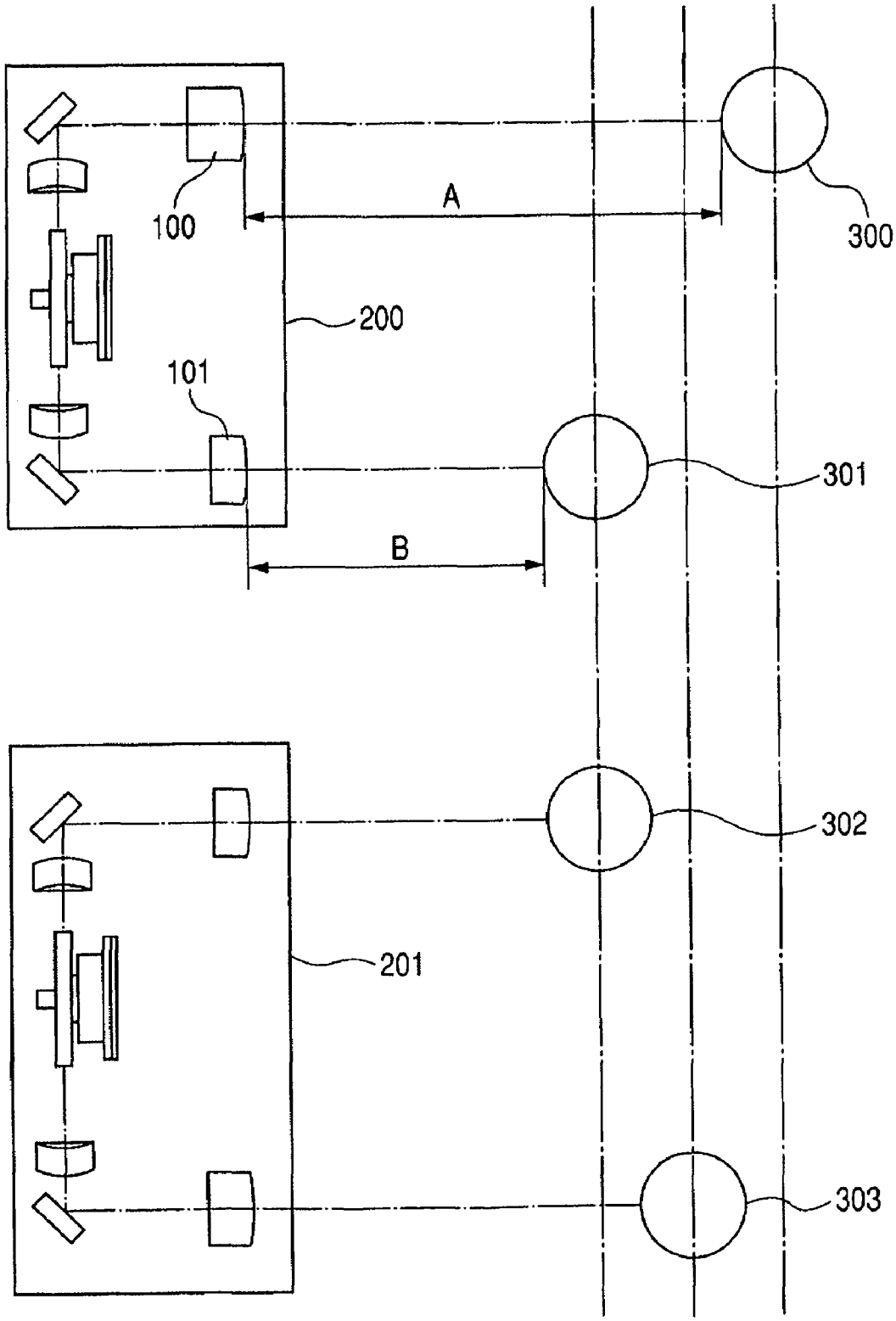
FIG. 4 is a schematic sectional view of an image forming apparatus according to a comparative example for the understanding of the present invention.

The second embodiment of the present invention will be described with reference to FIG. 3. FIG. 3 is an explanatory view of the image forming apparatus of the second embodiment. In the following, regarding the construction that is the same as described above, a description thereof will be omitted.

(Image Forming Apparatus)

As shown in FIG. 3, an image forming apparatus 52 of this embodiment has the first scanning optical device 16*a* and the second scanning optical device 16*b* as described above.

As in the above-described embodiment, light beams 51C, 51Y, 51M, and 51K emitted from the scanning optical devices 16*a* and 16*b* form latent images on the surfaces of photosensitive drums 50C, 50Y, 50M, and 50K. Of the four photosensitive drums, the black and cyan photosensitive drums 50K and 50C at the ends in the vertical direction (Z-direction shown in the figure) of the image forming apparatus 52 are arranged so as to protrude toward a transfer material conveying belt 54 (in the X-direction shown in the figure) by approximately 1 mm with respect to the magenta and yellow photosensitive drums 50M and 50Y.

The transfer material conveying belt 54 attracts a transfer material 53 to its outer peripheral surface on the left-hand side in the figure by electrostatic attraction, and circulates clockwise in the figure in order to bring the transfer material 53 into contact with the photosensitive drums 50C, 50Y, 50M, and 50K. Through the circulation of the transfer material conveying belt 54, the transfer material 53 is conveyed to transfer positions (the positions where it is opposed to the photosensitive drums). Then, toner images on the photosensitive drums 50C, 50Y, 50M, and 50K are transferred to the transfer material 53. When the toner images of the different colors have been successively transferred to the transfer material 53, a color image is formed on the transfer material 53. Then, the color image on the transfer material 53 is heat-fixed by a fixing device 55 before being output to the exterior of the apparatus.

Next, the positional relationship between the photosensitive drums 50, the light beams 51, and the scanning optical device 16 will be described.

The distance between the centers of the black photosensitive drum 50K and the magenta photosensitive drum 50M is the same as the distance between the centers of the yellow photosensitive drum 50Y and the cyan photosensitive drum 50C, and is the same as the distance between the centers of the magenta photosensitive drum 50M and the yellow photosensitive drum 50Y. The two light beams 51C and 51Y emitted from the first scanning optical device 16*a* are parallel to each other. Similarly, the two light beams 51M and 51K emitted from the second scanning optical device 16*b* are parallel to each other.

Here, in the image forming apparatus 52, the first virtual line l1 connecting the rotation center of the photosensitive drum 50C and the rotation center of the photosensitive drum 50Y, and the second virtual line l2 connecting the rotation center of the photosensitive drum 50M and the rotation center of the photosensitive drum 50K, are at an angle θ. Further, the second scanning optical device 16*b* is arranged so as to be inclined with respect to the first scanning optical device 16*a* according to the angle θ. In this embodiment, the angle θ is approximately 1° (degree). The first scanning optical device 16*a* and the second scanning optical device 16*b* are of the same construction.

As in the first embodiment, also in this embodiment, the optical path configuration of the third laser beam 51M and the optical path configuration of the first laser beam 51C are substantially the same, and the optical path configuration of the fourth laser beam 51K and the optical path configuration of the second laser beam 51Y are substantially the same, and the angle α made by the rotation axis x2 of the second rotary mirror 20*b* and the second virtual line l2 is the same as the angle α made by the rotation axis x1 of the first rotary mirror 20*a* and the first virtual line l1.

In this embodiment, even in an image forming apparatus having a construction in which, of the four photosensitive drums 50 (50C, 50Y, 50M, and 50K), the photosensitive drums 50C and 50K at the ends in the vertical direction (Z-direction shown in the figure) must protrude in the horizontal direction (in the X-direction shown in the figure), it is possible for the two scanning optical devices 16*a* and 16*b* to be substantially of the same construction, making it possible to achieve a reduction in the cost of the image forming apparatus.

Third Embodiment

Figure 13:
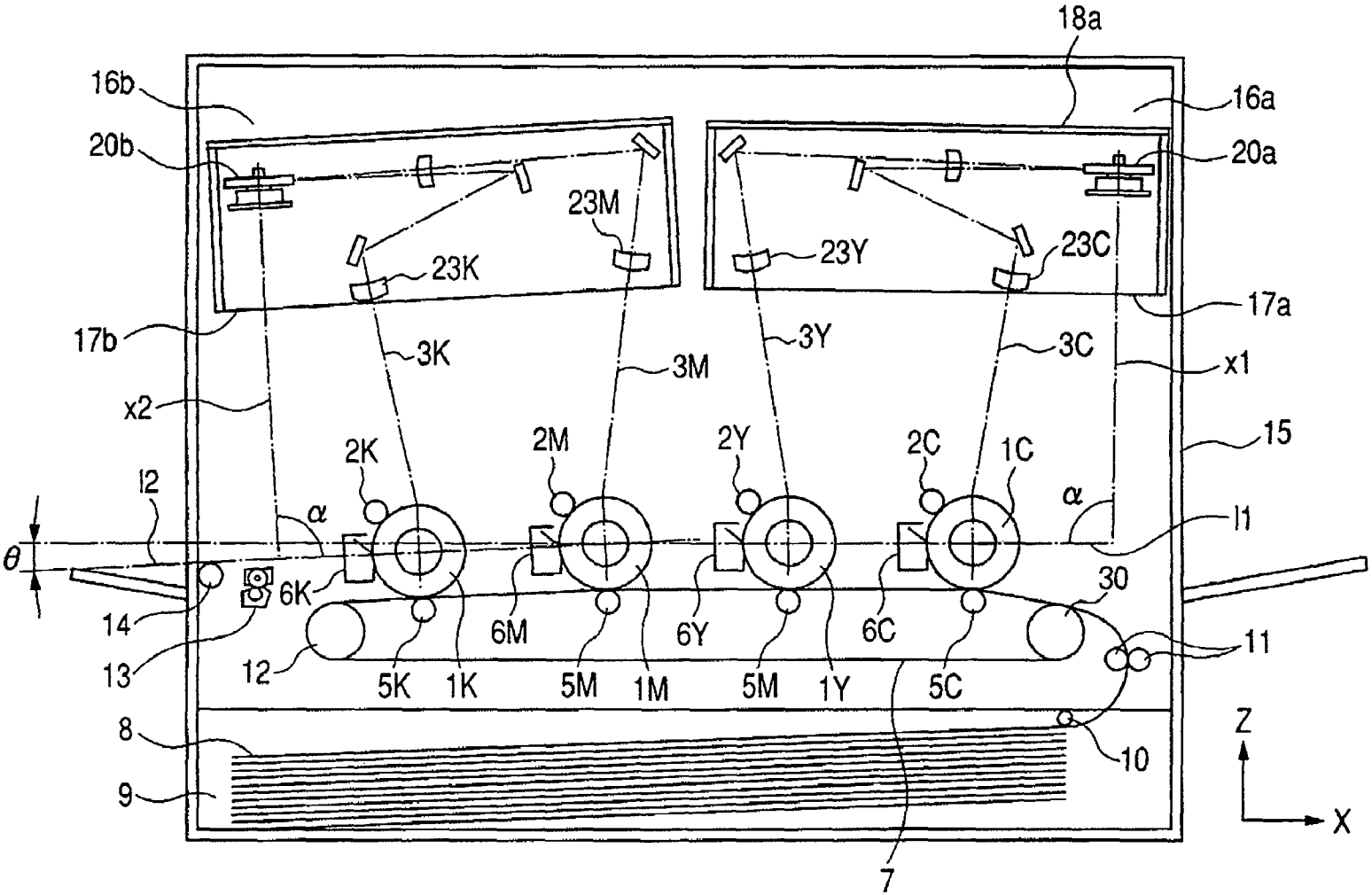
FIG. 13 is a schematic sectional view of an image forming apparatus according to a third embodiment of the present invention.
Figure 14:
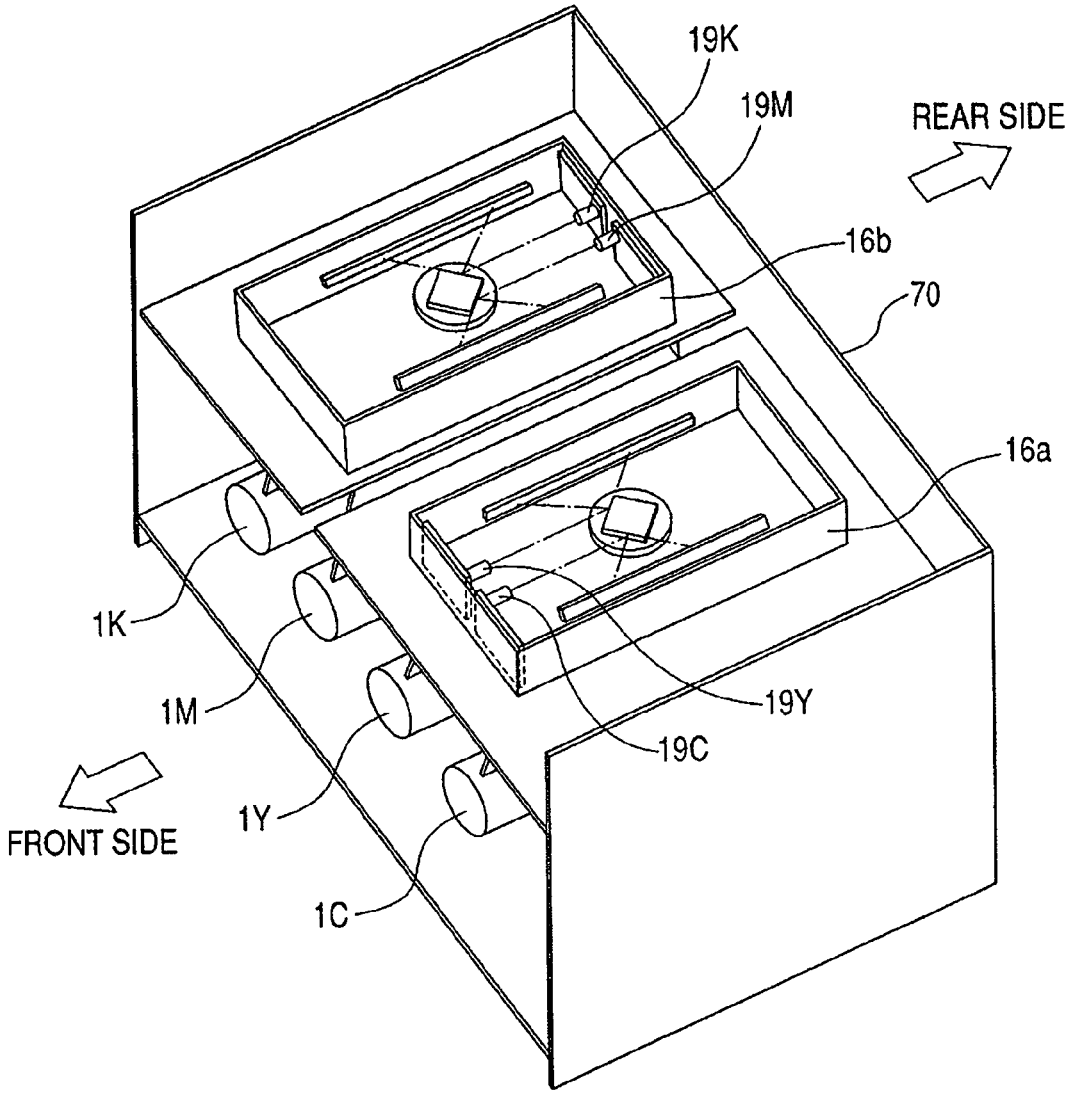
FIG. 14 is a perspective view of the image forming apparatus of the third embodiment.

FIGS. 13 and 14 show the third embodiment. In the first and second embodiments as described above, the optical path configuration of the first laser beam and the optical path configuration of the third laser beam are substantially the same, and the optical path configuration of the second laser beam and the optical path configuration of the fourth laser beam are substantially the same. In contrast, in this embodiment, the optical path configuration of the first laser beam and the optical path configuration of the fourth laser beam are substantially the same, and the optical path configuration of the second laser beam and the optical path configuration of the third laser beam are substantially the same. In this case, as shown in FIG. 14, the two systems of laser sources 19C and 19Y mounted in the first laser scanner unit 16*a* are arranged on one side surface side (which is the front side in this embodiment), and the two systems of laser sources 19M and 19K mounted in the second laser scanner unit 16*b* are arranged on the other side surface side (which is the rear side in this embodiment).

However, in this embodiment also, the angle αα made by the rotation axis x2 of the second rotary mirror 20*b* and the second virtual line l2 is the same as the angle α made by the rotation axis x1 of the first rotary mirror 20*a* and the first virtual line l1, so that the plurality of optical elements mounted in the first laser scanner unit and the plurality of optical elements mounted in the second laser scanner unit can be substantially of the same optical characteristics. Thus, making effective use of the advantage of a 2-box type laser scanner unit, it is possible to suppress an increase in the cost of an image forming apparatus. Further, as in the first embodiment, it is possible to achieve a further reduction in cost by making the optical box 17*a* and the optical box 17*b* of the same construction.

Other Embodiments

While in the above-described embodiments the colors are arranged in the order: cyan C, yellow Y, magenta M, and black K, this should not be construed restrictively. It is possible to attain the same effect if the colors are arranged in a different order.

It is not always necessary for the two systems of laser beams emitted from one scanning optical device to be parallel to each other; they may also be non-parallel as shown in FIGS. 10, 12, and 13.

Further, as long as the optical components of the scanning optical systems of the two scanning optical devices are the same, the configurations of the components forming the exterior of the scanning optical devices, such as the optical boxes and the optical cover, may be different.

The present invention is not restricted to the above-described embodiments but covers modifications not departing from the technical idea thereof.

This application claims priority based on Japanese Patent Application No. 2004-212857 filed on Jul. 21, 2004 and Japanese Patent Application No. 2005-200465 filed on Jul. 8, 2005, the contents of which are cited herein to constitute a part of the present application.

The invention claimed is:

1. An image forming apparatus comprising:

a first laser scanner unit for emitting a first laser beam and a second laser beam, which has a first laser source for generating the first laser beam, a second laser source for generating the second laser beam, and a first rotary mirror for deflecting the first laser beam and the second laser beam generated from the first laser source and the second laser source;

a second laser scanner unit for emitting a third laser beam and a fourth laser beam, which has a third laser source for generating the third laser beam, a fourth laser source for generating the fourth laser beam, and a second rotary mirror for deflecting the third laser beam and the fourth laser beam generated from the third laser source and the fourth laser source;

a first photosensitive member irradiated with the first laser beam;

a second photosensitive member irradiated with the second laser beam;

a third photosensitive member irradiated with the third laser beam; and a fourth photosensitive member irradiated with the fourth laser beam, characterized in that:

an optical path configuration for the third laser beam from the third laser source to the third photosensitive member is substantially the same as an optical path configuration for the first laser beam from the first laser source to the first photosensitive member;

an optical path configuration for the fourth laser beam from the fourth laser source to the fourth photosensitive member is substantially the same as an optical path configuration for the second laser beam from the second laser source to the second photosensitive member; and a second virtual line connecting a rotation center of the third photosensitive member and a rotation center of the fourth photosensitive member is inclined with respect to a first virtual line connecting a rotation center of the first photosensitive member and a rotation center of the second photosensitive member, and an angle made by a rotation axis of the second rotary mirror and the second virtual line being the same as an angle made by a rotation axis of the first rotary mirror and the first virtual line.

2. An image forming apparatus according to claim 1, characterized in that an angle made by the first laser beam emitted from the first laser scanner unit and the third laser beam emitted from the second laser scanner unit and an angle made by the second laser beam emitted from the first laser scanner unit and the fourth laser beam emitted from the second laser scanner unit are both equal to the angle made by the first virtual line and the second virtual line.

3. An image forming apparatus according to claim 1, characterized in that a distance from the second photosensitive member to a position of the first laser scanner unit from which the second laser beam is emitted is equal to a distance from the fourth photosensitive member to a position of the second laser scanner unit from which the fourth laser beam is emitted.

4. An image forming apparatus according to claim 1, characterized in that the first laser scanner unit has a first optical box supporting the first laser source, the second laser source and the first rotary mirror, and the second laser scanner unit has a second optical box supporting the third laser source, the fourth laser source and the second rotary mirror.

5. An image forming apparatus according to claim 4, characterized in that both the first optical box and the second optical box are resin moldings produced by using the same mold.

6. An image forming apparatus according to claim 4, further comprising a first supporting member for positioning and supporting the first optical box, and a second supporting member for positioning and supporting the second optical box, characterized in that the second supporting member is inclined with respect to the first supporting member so that the angle made by the rotation axis of the first rotary mirror and the first virtual line is equal to the angle made by the rotation axis of the second rotary mirror and the second virtual line.

7. An image forming apparatus according to claim 4, further comprising a supporting member for positioning and supporting the first optical box and the second optical box, characterized in that the supporting member includes two positioning portions making an angle so that the angle made by the rotation axis of the first rotary mirror and the first virtual line is equal to the angle made by the rotation axis of the second rotary mirror and the second virtual line.

8. An image forming apparatus according to claim 4, characterized in that an angle made by the first optical box and the second optical box is equal to an angle made by the first virtual line and the second virtual line.

9. An image forming apparatus according to claim 1, characterized in that the optical path configurations for all the first laser beam through the fourth laser beam are substantially the same.

10. An image forming apparatus according to claim 1, characterized in that all the four optical systems forming the optical paths for the first through fourth laser beams use optical elements that are substantially the same optically.

11. An image forming apparatus according to claim 1, characterized in that the rotation centers of the first photosensitive member through the third photosensitive member are arranged in a straight line, and the rotation center of the fourth photosensitive member is deviated from the straight line.

12. An image forming apparatus comprising:

a first laser scanner unit for emitting a first laser beam and a second laser beam, which has a first laser source for generating the first laser beam, a second laser source for generating the second laser beam, and a first rotary mirror for deflecting the first laser beam and the second laser beam generated from the first laser source and the second laser source;

a second laser scanner unit for emitting a third laser beam and the fourth laser beam, which has a third laser source for generating the third laser beam, a fourth laser source for generating the fourth laser beam, and a second rotary mirror for deflecting the third laser beam and the fourth laser beam generated from the third laser source and the fourth laser source;

a first photosensitive member irradiated with the first laser beam;

a second photosensitive member irradiated with the second laser beam;

a third photosensitive member irradiated with the third laser beam; and a fourth photosensitive member irradiated with the fourth laser beam, characterized in that:

an optical path configuration for the third laser beam from the third laser source to the third photosensitive member is substantially the same as an optical path configuration for the second laser beam from the second laser source to the second photosensitive member;

an optical path configuration for the fourth laser beam from the fourth laser source to the fourth photosensitive member is substantially the same as an optical path configuration for the first laser beam from the first laser source to the first photosensitive member; and a second virtual line connecting a rotation center of the third photosensitive member and the rotation center of the fourth photosensitive member is inclined with respect to a first virtual line connecting a rotation center of the first photosensitive member and a rotation center of the second photosensitive member, and an angle made by a rotation axis of the second rotary mirror and the second virtual line being the same as an angle made by a rotation axis of the first rotary mirror and the first virtual line.

13. An image forming apparatus comprising:

a first laser scanner unit for emitting a first laser beam and a second laser beam, which has a first laser source for generating the first laser beam, a second laser source for generating the second laser beam, and a first rotary mirror for deflecting the first laser beam and the second laser beam generated from the first laser source and the second laser source;

a second laser scanner unit for emitting a third laser beam and a fourth laser beam, which has a third laser source for generating the third laser beam, a fourth laser source for generating the fourth laser beam, and a second rotary mirror for deflecting the third laser beam and the fourth laser beam generated from the third laser source and the fourth laser source;

a first photosensitive member irradiated with the first laser beam;

a second photosensitive member irradiated with the second laser beam;

a third photosensitive member irradiated with the third laser beam; and a fourth photosensitive member irradiated with the fourth laser beam, characterized in that an angle made by the first laser scanner unit and the second laser scanner unit is equal to an angle made by a first virtual line connecting a rotation center of the first photosensitive member and a rotation center of the second photosensitive member and a second virtual line connecting a rotation center of the third photosensitive member and a rotation center of the fourth photosensitive member.

* * * * *